US006342016B1

(12) United States Patent
Parker

(10) Patent No.: US 6,342,016 B1
(45) Date of Patent: Jan. 29, 2002

(54) WATERFALL DIVERTER

(76) Inventor: Christopher W Parker, 15-D Ui Pl., Lahaina, HI (US) 96761

( * ) Notice: Subject to any disclaimer, the term of this patent is extended or adjusted under 35 U.S.C. 154(b) by 0 days.

(21) Appl. No.: 09/655,080

(22) Filed: Sep. 5, 2000

(51) Int. Cl.[7] ..... A63G 31/00
(52) U.S. Cl. ..... 472/128; 472/117
(58) Field of Search ..... 472/13, 43, 117, 472/128; 104/53, 69, 70; 239/67, 99, 101

(56) References Cited

U.S. PATENT DOCUMENTS 617,154 A * 1/1899 Gates ..... 104/70
5,685,778 A * 11/1997 Sheldon et al. ..... 472/43
5,839,964 A * 11/1998 Rudell et al. ..... 472/117

* cited by examiner

*Primary Examiner*—Kien T. Nguyen
(74) *Attorney, Agent, or Firm*—Michael I Kroll

(57) ABSTRACT

A waterfall diversion apparatus is provided consisting of a modified cylinder in which a supply of water which normally cascades over a portion of roller coaster track as a waterfall is temporarily diverted as the passenger carrying cars of the roller coaster pass underneath before the diverter mechanism rotates back to a non-diverter position and the waterfall resumes. The rotating diverter member is a cylinder-like device having a plow like inner divider which when rotated into the path of the water fall diverts the water to the ends of the cylinder where it continues in an outward path to the left and right of the passenger carrying cars of the roller coaster. The modified cylinder is normally obscured from view by the waterfall passing over the exterior surface of the diverter member. As the passenger carrying cars approach the waterfall it trips a mechanism which causes a pneumatically or hydraulically controlled piston to rotate the cylinder until the scoop and plow-like diverter blade moves to an operative position just as the passenger carrying cars are underneath. The water being divergently ejected from the ends of the cylinder, appears to be splashing off of the passenger cars. The timing of the diverter mechanism is set so that even the ride occupants are convinced that they are going to pass through the waterfall. After passing under the diverted waterfall, sensors trip the piston directing the cylinder into a retracted position thus allowing water to continue along its normal arterial flow.

16 Claims, 9 Drawing Sheets

WATERFALL DIVERTER

BACKGROUND OF THE INVENTION

1. Field of the Invention

The present invention relates generally to amusement apparatus and, more specifically, to a rotating waterfall diverter apparatus. The present invention is a mechanical device which temporarily diverts a supply of water which normally cascades over a portion of roller coaster track as a waterfall as the passenger carrying cars of a roller coaster pass underneath and then returns to a non-diverting configuration whereupon the waterfall resumes. The diverter mechanism does not impede the water flow but directs the flow to the sides so that to the casual observer it appears that the ride occupants on the roller coaster pass through the waterfall.

The mechanism is normally obscured from view by the waterfall passing over the exterior surface. As the passenger cars approach the waterfall, it trips a mechanism which causes the diverter to move into an operative position just as the passenger carrying cars pass underneath. The water being ejected to the side appears to be splashing off of the passenger cars. The timing of the diverter mechanism would be set so that even the ride occupants are convinced that they are going to pass through the waterfall. Immediately thereafter, the diverter returns to its default position thus allowing water to continue along its normal arterial flow. The present invention provides the means to increase the thrill to the roller coaster experience adding to the adventure and stimulation experienced by the rider.

2. Description of the Prior Art

There are other water diversion devices designed for amusement apparatus. Typical of these is U.S. Pat. No. 5,685,778 issued to Benjamin Sheldon on Nov. 11, 1997.

U.S. Pat. No. 5,685,778

Inventor: Benjamin Sheldon

Issued: Nov. 11, 1997

A ride attraction has vehicles on a vehicle path. An animated figure over or on one side of the vehicle path is concealed from the path, and passengers in the vehicles on the path, by a waterfall. As the vehicles approach the waterfall, a diverter closes off the waterfall or diverts the waterfall into side walls creating an opening and exposing the animated figure. Simultaneously, the animated figure moves forward through the waterfall, or the plane of the waterfall, and approaches the oncoming vehicle. The sudden emergence and movement of the animated figure from a concealed position behind the waterfall adds to the excitement of the ride attraction.

While these waterfall diversion devices may be suitable for the purposes for which they were designed, they would not be as suitable for the purposes of the present invention, as hereinafter described.

SUMMARY OF THE PRESENT INVENTION

A primary object of the present invention is to provide a waterfall diversion apparatus as part of a roller coaster amusement ride which will maintain the illusion of a continuous waterfall to the ride passengers while preventing them from getting wet.

Another object of the present invention is to provide a waterfall diversion device that will not interfere with the normal course of the falling water when inactive.

Yet another object of the present invention is to provide a waterfall diversion device in which the falling water path is diverted to the left and right in a splash effect to maintain the illusion of a continuous waterfall to onlookers on either side of the waterfall feature.

Still yet another object of the present invention is to provide a waterfall diversion device in which the falling water path is diverted to the left and right in a splash effect so quickly so as not to visually alert the passengers of the impending change thus heightening their anticipation and expectation of an imminent soaking.

Yet another object of the present invention is to provide a waterfall diversion device in which the falling water path is diverted to the left and right in a splash effect having sufficient support structures to provide quick and safe operation of the diverting mechanism.

Additional objects of the present invention will appear as the description proceeds.

The present invention overcomes the shortcomings of the prior art by providing a waterfall diversion apparatus consisting of a modified cylinder in which a supply of water which normally cascades over a portion of roller coaster track as a waterfall is temporarily diverted as the passenger carrying cars of the roller coaster pass underneath before the diverter mechanism rotates back to a non-diverter position and the waterfall resumes. The diverter mechanism does not impede the water flow but directs the flow out the sides of the cylinder so that to the casual observer it appears that the ride occupants on the roller coaster pass through the waterfall.

The rotating diverter member is a cylinder like device having a plow like inner divider which when rotated into the path of the water fall diverts the water to the ends of the cylinder where it continues in an outward path to the left and right of the passenger carrying cars of the roller coaster. The rotating diverter member further comprises structural support members positioned on each distal end, which attach to the axis of rotation for the rotating diverter member.

The modified cylinder is normally obscured from view by the waterfall passing over the exterior surface of the diverter member. As the passenger carrying cars approach the waterfall it trips a mechanism which causes a pneumatically or hydraulically controlled piston to rotate the cylinder until the scoop and plow-like diverter blade moves to an operative position just as the passenger carrying cars are underneath. The water being divergently ejected from the ends of the cylinder appears to be splashing off of the passenger cars. The timing of the diverter mechanism would be set so that even the ride occupants are convinced that they are going to pass through the waterfall.

After passing under the diverted waterfall, sensors trip the piston directing the cylinder into a retracted position thus allowing water to continue along its normal arterial flow. The present invention provides the means to increase the thrill to the roller coaster experience adding to the adventure and stimulation experienced by the rider.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
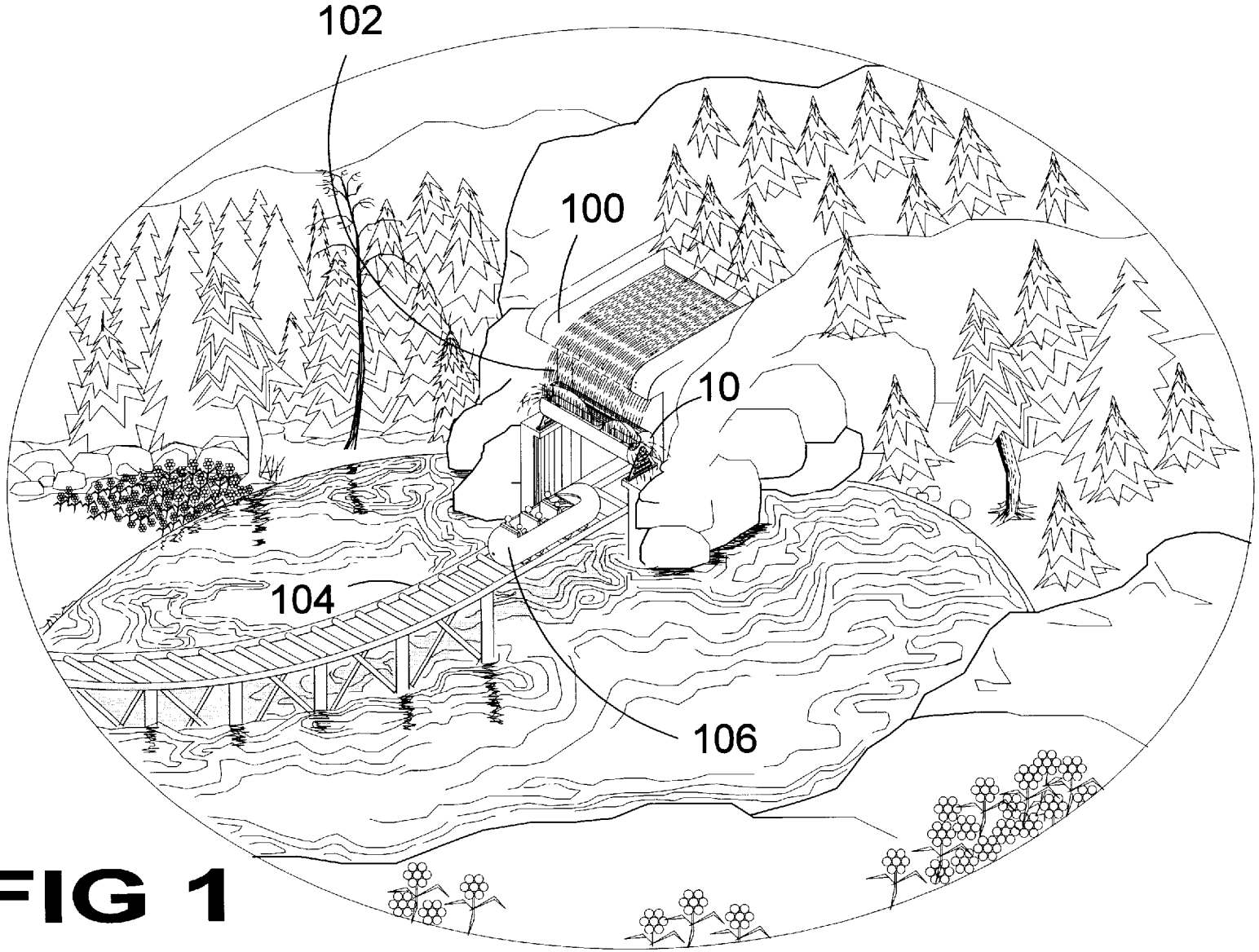
FIG. 1 is a perspective illustration depicting the present invention mounted under a waterfall. The waterfall diversion device is shown in the diverting configuration wherein the arterial flow of water is diverted into the scoop cylinder, thus preventing the cascade from encountering the passengers or vehicles.

Turning now descriptively to the drawings, in which similar reference characters denote similar elements throughout the several views, the FIGURES illustrate the waterfall diverter of the present invention. With regard to the reference numerals used, the following numbering is used throughout the various drawing figures.

10 waterfall diverter
20 frame
22 frame elongated opening
24 left end opening
26 right end opening
28 frame left end
30 frame right end
32 frame extension
40 diverter
42 diverter apex
44 diverter left side
46 diverter right side
48 diverter central portion
50 frame left support
52 frame right support
54 axle
60 piston mechanism
62 shaft
64 shaft forked end
66 lock pin
100 elevated water discharge source
102 discharged water
104 passenger conveyance path
106 passenger conveyance

DETAILED DESCRIPTION OF THE PREFERRED EMBODIMENT

Turning now descriptively to the drawings, in which similar reference characters denote similar elements throughout the several views, FIGS. 1 through 9 illustrate the waterfall diverter of the present invention indicated generally by the numeral 10.

Figure 4:
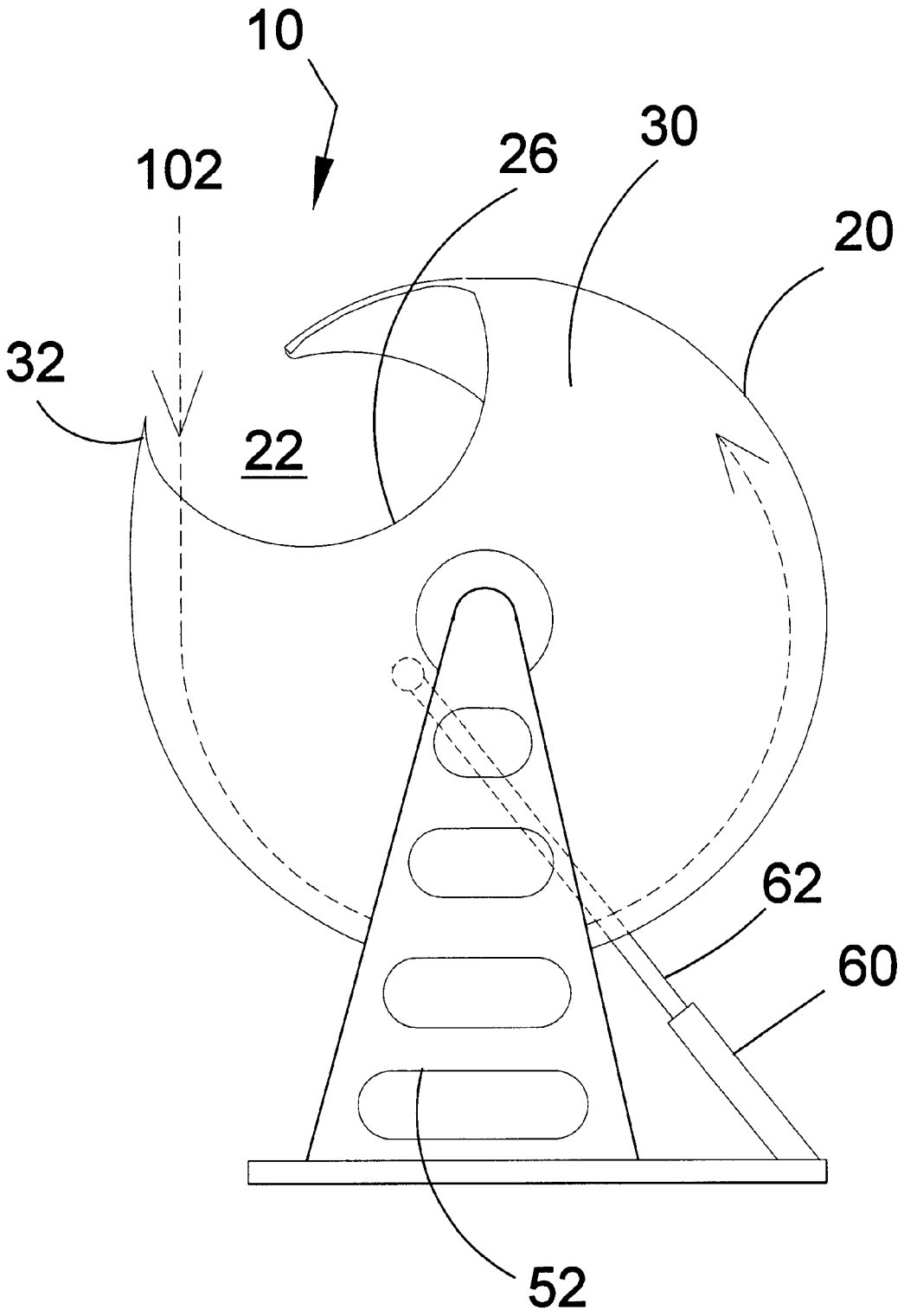
FIG. 4 is a side view of the present invention depicting the scoop cylinder in the diverting configuration allowing the flow of water into the internal cavity of the cylinder, thus diverting the waterfall. Also shown is the piston which provides the means of rotation to the cylinder.
Figure 9:
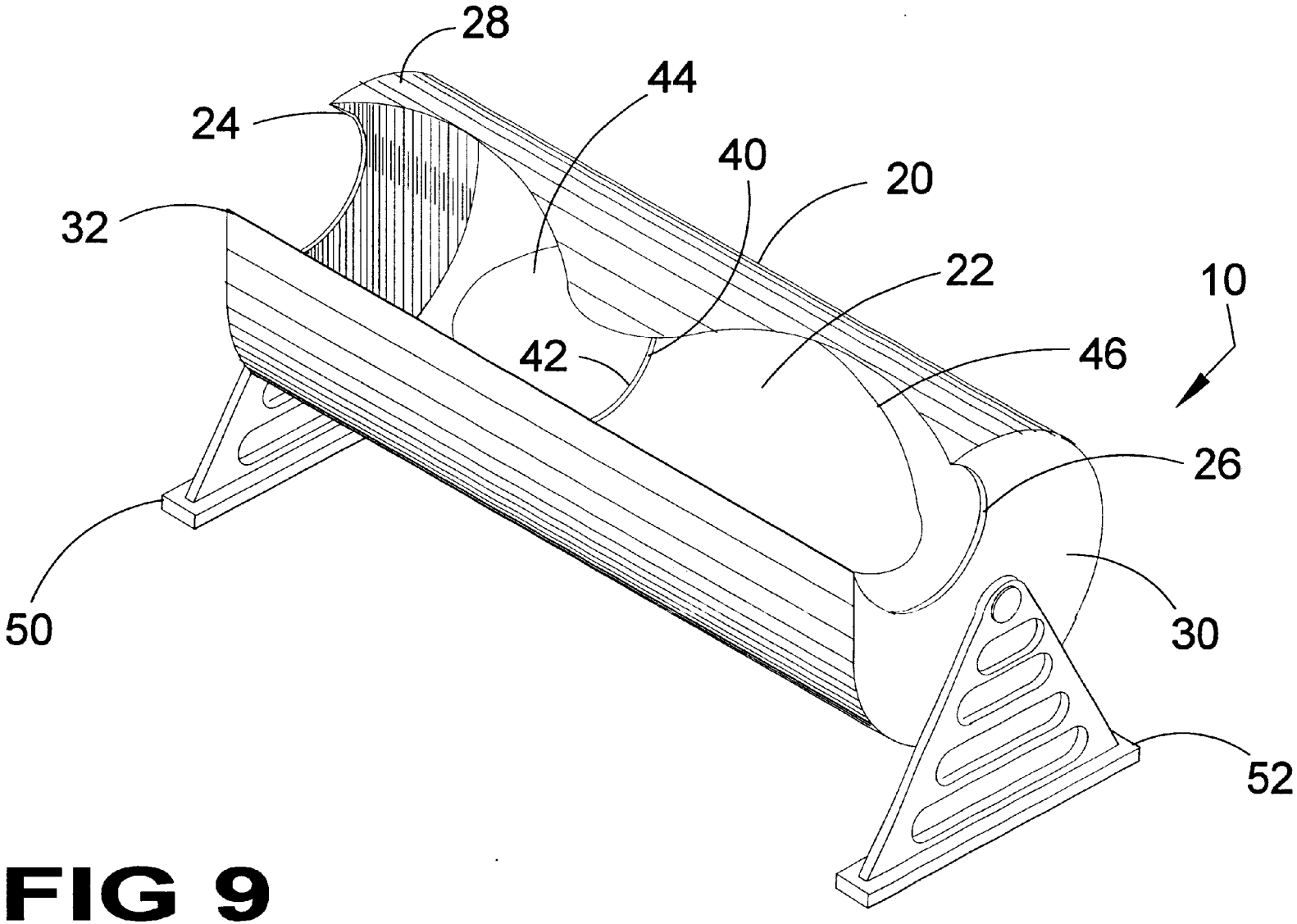
FIG. 9 is an alternate embodiment of the invention.

The device 10 is shown in FIG. 1, and in particular detail in FIGS. 3 through 6 and FIG. 9. The device 10 is a cylinder shaped frame 20 which has an elongated opening 22, which joins a left end opening 24 and a right end opening 26, at the left end 28 and right end 30 of the frame 20, respectively. A frame extension 32 defines a portion of the frame elongated opening 22, as shown in FIG. 4. Within the frame 20 is a diverter 40, which has an apex 42 and left and right sides 44 and 46, which descend gradually toward the frame left end 28 and right end 30. A diverter central portion 48 extends from the apex 42, beneath the diverter left and right sides 44 and 46. A left support 50 and a right support 52 are attached to an axle 54, the axle 54 being continuous through the frame 20. In an alternate embodiment, the frame is sufficiently rigid to allow the removal of the axle from the frame interior as shown in FIG. 9.

Figure 5:
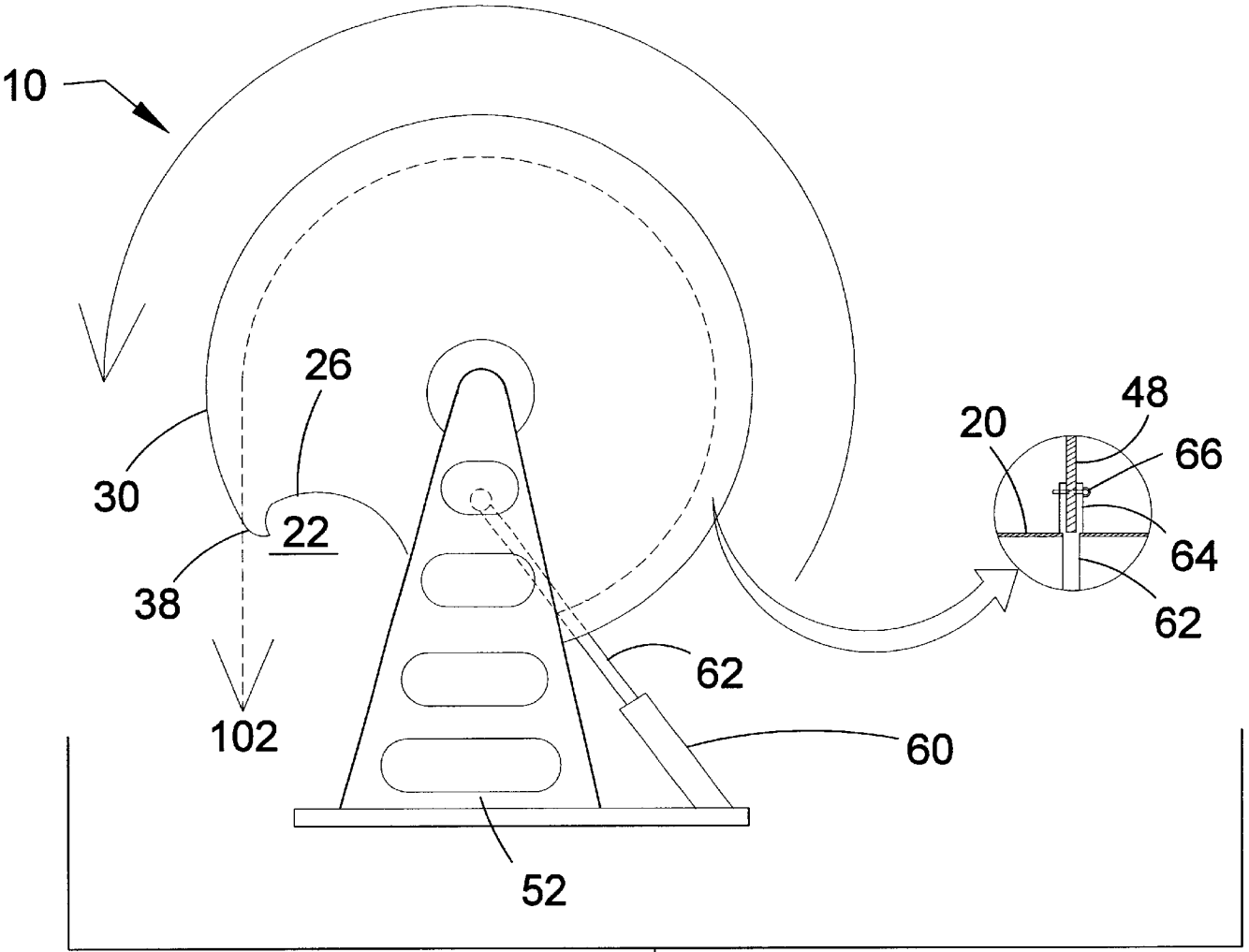
FIG. 5 is a side view of the present invention depicting the scoop cylinder in the non-diverting configuration allowing the flow of water to continue along its intrinsic course. Also shown, the piston retracting providing rotation of the diversion cylinder.

The frame 20 rotates on the axle 54 in response to a piston mechanism 60, which has a shaft 62, the shaft 62 being attached to the frame 20, as shown in FIGS. 4 and 5. The shaft 62 has a forked end 64 that is secured to the diverter central portion 48 by a lock pin 66. The point of attachment is a sufficient distance from the longitudinal center of the frame 20, to cause the frame 20 to rotate, in response to the extrusion of the piston shaft 62, from a first position, shown in FIG. 5, to a second position, i.e. the diverting position, as shown if FIG. 4. Upon retraction of the piston shaft 62, the frame 20 returns to the first position. The piston mechanism 60 can be hydraulic or pneumatic, and can be powered by conventional means, e.g. an electric motor.

As shown in FIGS. 1–2 and 7–8, the device 10 is placed under an elevated water discharge source 100, which typically discharges water 102 onto the path 104 traveled by passenger conveyances 106, in typical amusement park rides, e.g. roller coasters. The water 102 is typically discharged in the form of a waterfall.

Figure 2:
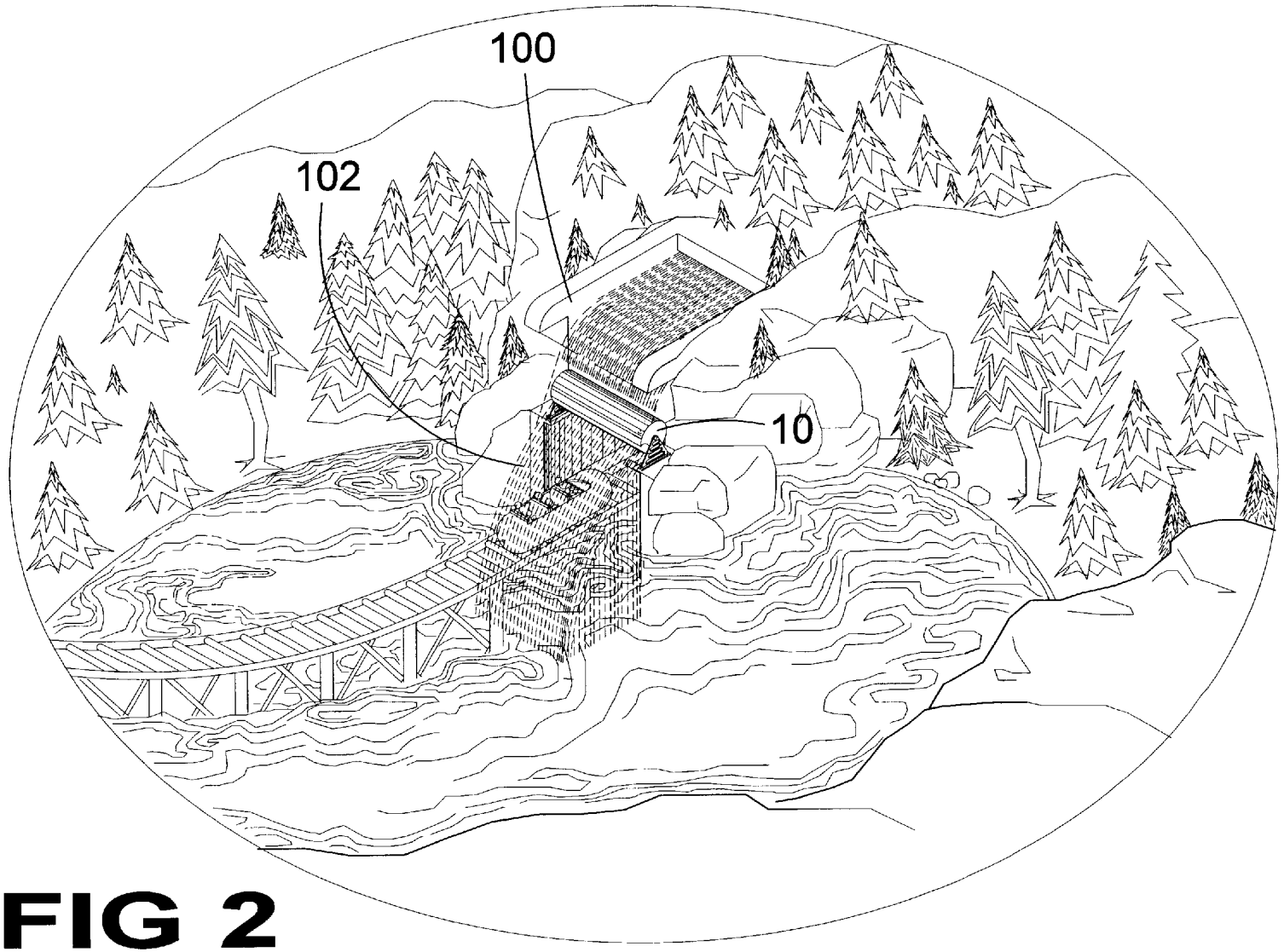
FIG. 2 is a perspective illustration depicting the present invention mounted under a waterfall. The diversion device is shown in the non-diverting configuration allowing the arterial flow of water to cascade in its intrinsic direction.
Figure 3:
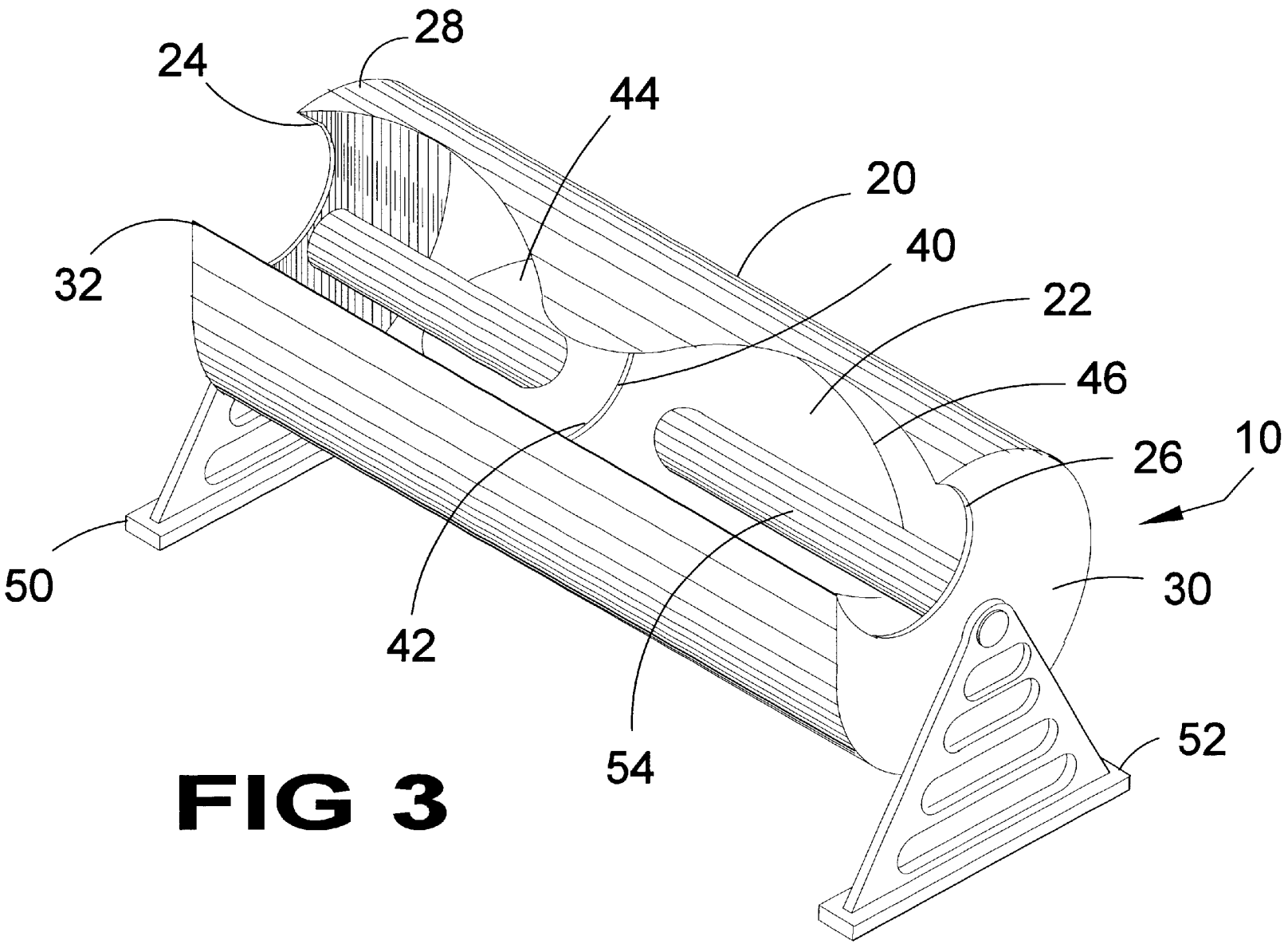
FIG. 3 is a perspective view of the present invention depicting the scoop cylinder or waterfall diversion apparatus and structural supports.
Figure 7:
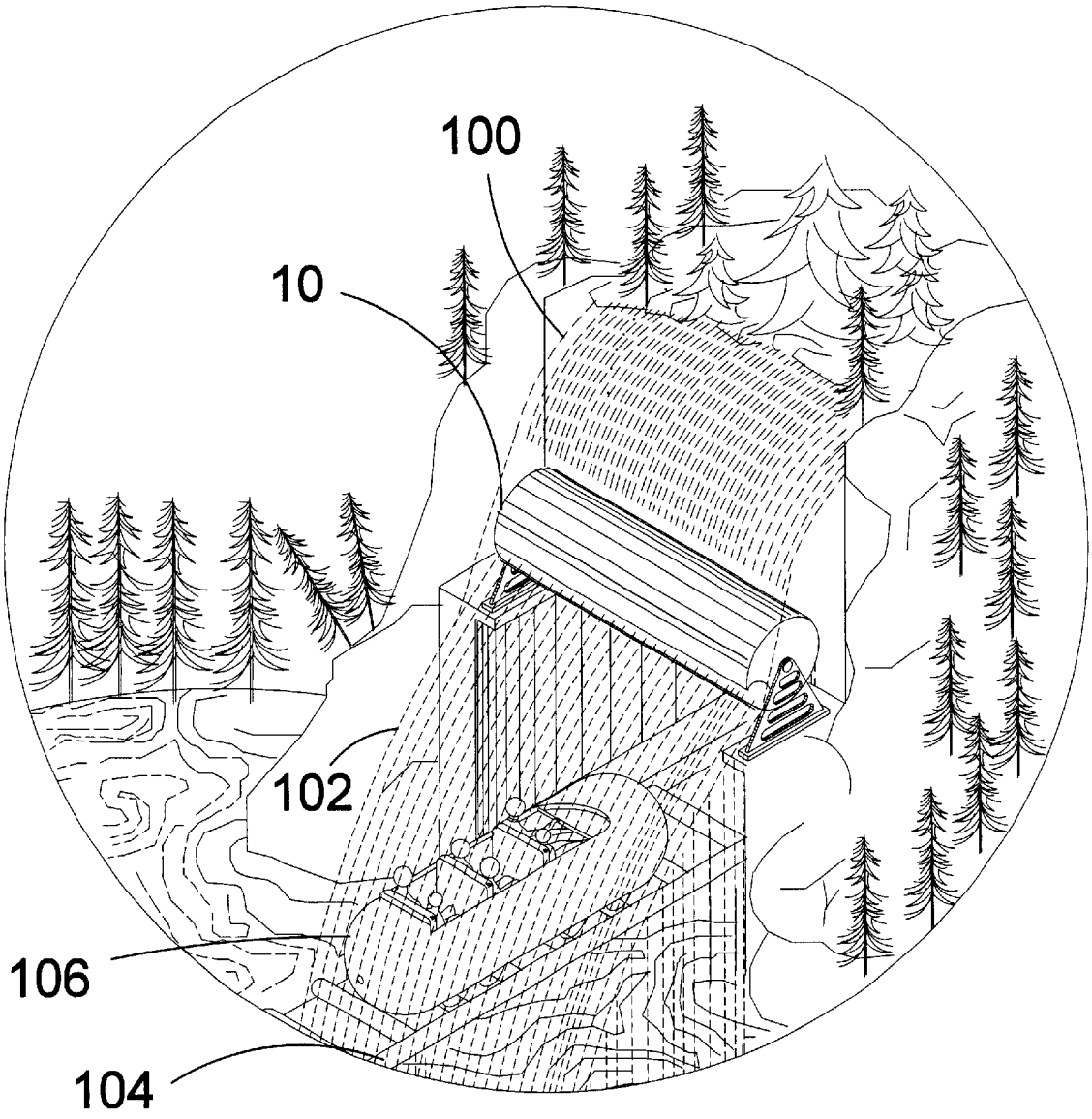
FIG. 7 is a perspective view depicting the diversion cylinder rotated back out of the way, allowing the flow of water to continue along its intrinsic course.

The frame 20 can be positioned with respect to the waterfall such that substantially all of the water 102 falls to the conveyance path 104 without encountering the frame 20, as shown in FIG. 7. In this first position, the frame's elongated opening 22 faces in a substantially downward position, as shown in FIGS. 2,5 and 7.

In response to an activation mechanism which is triggered by the approaching conveyance 106, the piston mechanism 60 is activated causing the shaft 62 to extrude and rotate the frame 20 into the second position, as shown in FIG. 1 and FIGS. 3–4 and 6. Although the frame 20 is generally cylindrical, the frame extension 32 extends beyond the perimeter of the cylinder's profile, as shown in FIG. 4. In this second position, the frame extension 32 encounters and "scoops" substantially all of the falling water 102 that would have otherwise fallen on the conveyance path 104. Almost immediately before the conveyance 106 would have encountered the falling water 102, the rotation of the frame 20 causes the water 102 to enter the frame 20.

Figure 6:
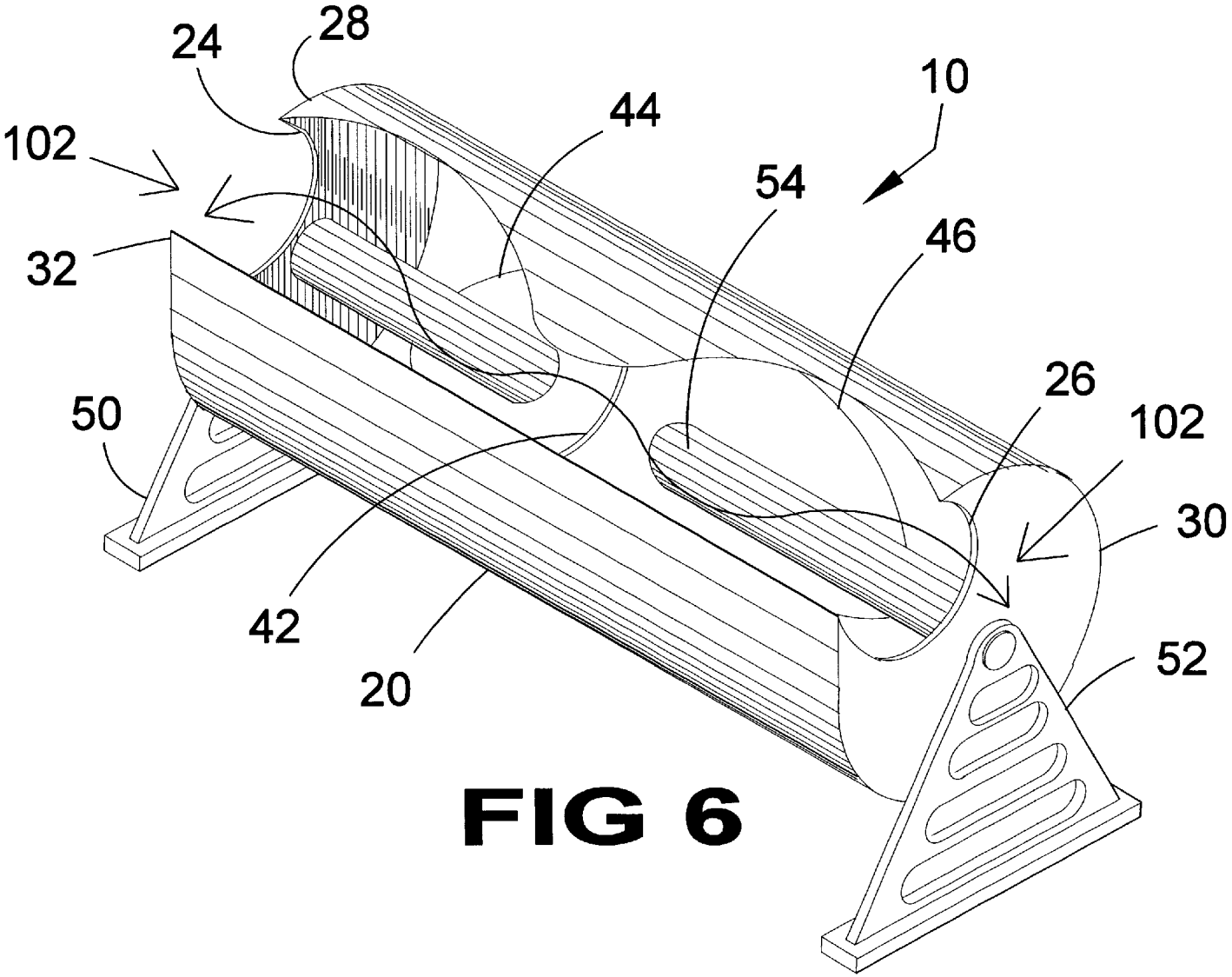
FIG. 6 is a perspective view of the present invention illustrating the flow of water temporarily captured and diverted by the diversion apparatus. The cylinder is shown in the "scoop" or diverting configuration.

Water 102 entering the frame elongated opening 22, is urged toward the frame left end 28 or right end 30, by the diverter 40, as illustrated in FIG. 6. Such water 102 is divided into two portions at the diverter apex 42, with the diverter left side 44 and right side 46 expediting the waters 102 movement toward the frame left end 28 and right end 30.

Figure 8:
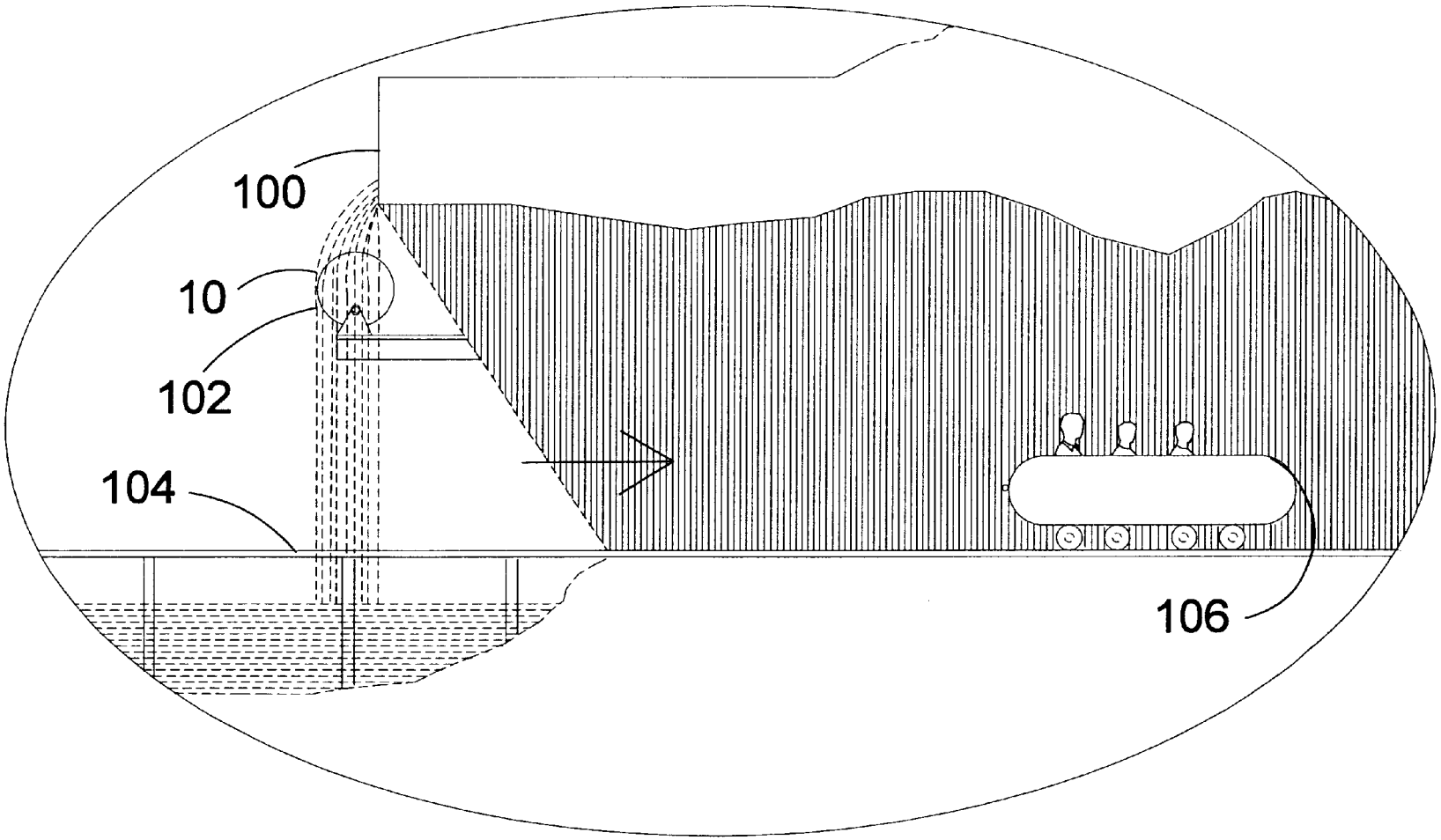
FIG. 8 is a side sectional view illustrating the continuation of excitement after the unexpected waterfall thrill. As the ride proceeds under the paused waterfall in total darkness, anticipation heightens about what will occur next.

In this embodiment, water 102 accumulates near the frame left end 28 and right end 30 until the water level reaches the lower edge of the frame left end opening 24 and right end opening 26. The size, shape and positioning of the left end opening 24 and right end opening 26, encourage a more turbulent discharge of the water 102 from the left end 28 and right end 30. This creates a splashing motion, which contributes to the visual illusion, from the side, that the water 102 is falling on the conveyance, as shown in FIG. 1. This visual effect is also enhanced by choosing the width of the frame 20 to be wider than the conveyance 106, but shorter than the width of the waterfall, as shown in FIG. 8. Depending upon the positioning of the waterfall in the park, the diverter 40 can be relocated, in other embodiments, from its central position in the frame 20, toward the frame left end 28 or right end 30. The amount of relocation could be chosen as needed to divert a larger amount of water 102 toward the end most observable by bystanders, thus causing a larger splashing effect on the observed end.

Once the conveyance 106 has cleared the portion of the conveyance path 104 that is normally encountered by the falling water 102, the piston mechanism 60 is again activated by the conveyance-triggered activation mechanism. This causes the piston shaft 62 to retract and rotate the frame 20 back to the first position, as shown in FIG. 4. Because of the accumulation of water 102 within the frame 20, this rotation of the frame 20 dumps the water 102 behind the conveyance 106. Since this dumping occurs almost immediately after the conveyance 106 has cleared the waterfall's ordinary path, the illusion is enhanced that the conveyance 106 has encountered the falling water 102, as shown in FIGS. 2 and 7.

Conveyance-triggered activation mechanisms are conventional and common in the amusement park ride industry. Conventional mechanical, electrical, and wireless electronic signal activation mechanisms will all provide the necessary response to the passenger conveyance 106 as the passenger conveyance 106 approaches or exits.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an amusement park ride of the type having a conveyance for transporting one or more passengers along a path, an elevated water source that discharges water onto a portion of the path, and a conveyance-triggered activation mechanism for initiating one or more mechanical devices, the improvement, which comprises:

(a) a frame, the frame having a left end, a right end, an interior, a divider in the frame interior, the frame further having an elongated opening, a left end opening, and a right end opening;

(b) a frame support for rotatably supporting the frame; and (c) a rotation mechanism for rotating the frame between a first and a second position in response to the conveyance-triggered activation mechanism, the frame opening receiving water discharge only in the second position, the frame elongated opening allowing passage of the received water into the frame interior, the frame divider displacing a first received water portion to the frame left end and a second received water portion to the frame right end, the first and second received water portions exiting through the frame left end opening and frame right end opening, respectively.

2. The improvement of claim 1, wherein the frame left and right end openings are sized and positioned such that the frame interior holds a portion of the first and second received water portions at the time the frame begins moving from its second to its first position, such water portion being dumped from the frame as the frame moves to its first position.

3. The improvement of claim 1, wherein the frame is generally cylindrical, the frame further having an extension, the extension extending beyond the perimeter of the cylindrical frame.

4. The improvement of claim 1, wherein the divider is plow shaped.

5. The improvement of claim 1, wherein the divider has an apex, a left portion and a right portion, the left portion and right portion each descending from the apex toward the frame left end and frame right end, respectively.

6. The improvement of claim 1, wherein the elevated water source is of the type that discharges water in the form of a waterfall.

7. The improvement of claim 1, wherein the conveyance-triggered activation mechanism includes means to cause the frame to return to the first position after the conveyance passes under the frame.

8. The improvement of claim 1, wherein the conveyance-triggered activation mechanism includes means to move the frame into the second position only when the conveyance approaches and is close to the water being discharged.

9. The improvement of claim 1, wherein the rotation mechanism is a piston member, the piston member, the piston member having a shaft, the shaft having a first position and a second position, the shaft being attached to the frame such that when the shaft is in the first position the frame is in the first position, and when the shaft is in the second position the frame is in the second position.

10. The improvement of claim 1, wherein the divider is centrally positioned within the frame interior.

11. The improvement of claim 1, wherein the frame left and right end openings are positioned on the frame left and right ends, respectively, such that each is continuous with the frame elongated opening.

12. The improvement of claim 1, further comprising a rotation axle, the rotation axle being continuous between the frame left and right ends, the rotation axle being attached to the frame support for rotation of the frame.

13. The improvement of claim 1, further comprising a pair of independent rotation axles, the first rotation axle being positioned at the frame left end, the second rotation axle being positioned at the frame right end, each rotation axle being attached to the frame support for rotation of the frame.

14. In an amusement park ride of the type having a conveyance for transporting one or more passengers along a path, an elevated water source that discharges water onto a portion of the path, and a conveyance-triggered activation mechanism for initiating one or more mechanical devices, the improvement, which comprises:

(a) means for interrupting and catching the discharged water and diverting it to the left and right of the conveyance path while the conveyance is proximate the portion of the path onto which the water is ordinarily discharged; and (b) means for restoring the water discharge onto the path after the conveyance has passed.

15. The improvement of claim 14, further comprising means for causing a splashing of the water as it is diverted to the left and right of the conveyance path.

16. The improvement of claim 14, further comprising means for dumping a portion of the water onto the conveyance path immediately after the conveyance has passed.

* * * * *